United States Patent [19]

Johansson

[11] Patent Number: 5,039,318

[45] Date of Patent: Aug. 13, 1991

[54] DEVICE AT WET ELECTROSTATIC PRECIPITATOR

[75] Inventor: Harry Johansson, Skellefteå, Sweden

[73] Assignee: Boliden Contech AB, Stockholm, Sweden

[21] Appl. No.: 476,455

[22] PCT Filed: Nov. 2, 1989

[86] PCT No.: PCT/SE89/00617

§ 371 Date: Jun. 6, 1990

§ 102(e) Date: Jun. 6, 1990

[87] PCT Pub. No.: WO90/05027

PCT Pub. Date: May 17, 1990

[30] Foreign Application Priority Data

Nov. 4, 1988 [SE] Sweden ..... 8804008-4

[51] Int. Cl.[5] ..... B03C 3/00

[52] U.S. Cl. ..... 55/135; 165/159; B03C/3/00

[58] Field of Search ..... 55/135; 165/159

[56] References Cited

U.S. PATENT DOCUMENTS 1,393,712 10/1921 Steere et al. ..... 55/135

1,473,806 11/1923 Bradley ..... 55/135

FOREIGN PATENT DOCUMENTS 2743292 4/1981 Fed. Rep. of Germany .

1346464 of 1919 United Kingdom .

*Primary Examiner*—Bernard Nozick

*Attorney, Agent, or Firm*—Burns, Doane, Swecker & Mathis

[57] ABSTRACT

The invention relates to an arrangement in a wet electrostatic precipitator (1) intended for cleansing moisture-and-dust laden gas. The wet electrostatic precipitator (1) includes a condensing cooling arrangement (21) which is integrated with the precipitator unit (20) of the electrostatic precipitator. A plurality of emission electrodes (4) are located within the collector electrodes (5) and the collector electrodes extend through the cooling arrangement (21). Means in the form of distribution pipes (50, 60) are disposed in the upper and lower end-parts of the precipitator unit (20), in a manner such as to achieve uniform distribution of cooling medium (23) on the outer surfaces of the collector electrodes (5), the gas flowing forwardly within the collector electrodes (5). This uniform distribution of cooling medium results in a reduction in the rate of corrosion on the inner surfaces of the collector electrodes (5), as a result of the formation of condensation on these surfaces and as a result of the uniform and low temperature of the collector electrodes and also as a result of a lower concentration of corrosive substances in the condensate. This affords both technical and economical advantages and also enables the collector electrodes to be made of steel which has a relative low alloy content.

4 Claims, 3 Drawing Sheets

DEVICE AT WET ELECTROSTATIC PRECIPITATOR

The present invention relates to an improvement in wet electrostatic precipitators intended for cleansing moist and dust-laden gases and being of the kind which include a separator unit, a cooling condenser integrated with the separator unit, and emission electrodes which are disposed within a plurality of collector electrodes which extend through the cooling arrangement.

Electrostatic precipitators are used, for instance, for cleansing dust-laden gases deriving, inter alia, from sulphuric-acid production processes, metal-smelting processes, and coal-combustion and waste combustion-plants.

When the moist and dust-laden gases contain a given moisture content, the electrostatic precipitator will preferably have the form of a so-called wet electrostatic precipitator. Unfortunately, the moisture-saturated gases cause corrosion problems.

In the case of wet electrostatic precipitators which are intended, for instance, for treating moisture-saturated process gases and flue gases which contain $Cl^-$, $F^-$, $SO_2$, $SO_3$, etc. and other highly corrosive components, it has hitherto been necessary to manufacture in particular those components and parts of the precipitator subjected to corrosion attack from lead or plastics material. These materials have been found satisfactory from the aspect of corrosion in many instances, although they have, unfortunately, obvious limitations or, in many instances, have been highly unsuitable with respect to the fulfillment of other properties and characteristics which determine the function of the precipitator. The formation of cracks is one example of the problems which result from the use of lead and pastics material, although other problems also arise. Another example is that the surface of precipitator parts made from a plastic material are water repelling (hydrophobic), which prevents the formation of a uniformly dispersed liquid film on, for instance, the collector electrodes.

Steel exhibits clear advantages from a functional aspect. Steel constructions are wear resistant, dimensionally stable and can be readily inspected and examined. Furthermore, the material possesses good electrical properties and hydrophilic surface properties, i.e. properties which are directly decisive to the functional characteristics and performance of wet electrostatic precipitators, for instance.

The use of a highly-alloyed, stainless steel in, for instance, wet electrostatic precipitators is limited by the extent to which the steel can withstand the troublesome operating environment generated by moisture-saturated gas and elevated temperatures, without becoming corroded too quickly. Improved resistance to corrosion can be achieved by selecting certain stainless steel-alloys of high alloy contents. However, such high-alloyed steels are also subjected to corrosion, and in many cases to an unacceptably high degree of corrosion, when the temperature of the saturated gas begins to exceed, e.g., 40°-60° C.

In order to provide an improved corrosive environment for steel, it is particularly suitable to integrate a condensing cooling device in the actual precipitator unit of the electrostatic precipitator. The provision of a separate device for cooling the flue gas prior to said gas entering the separator unit of the electrostatic precipitator constitutes a considerably more expensive solution from an economic aspect.

Unfortunately, serious corrosion problems are also experienced in connection with wet electrostatic filters having integrated condensing cooling devices, since, as a result of varying degrees of unevenness in cooling of the hot gasses, the inner surface of the collecting electrodes which surround the emission electrodes and which may have the form, e.g., of hollow tubes, take-up the liquid condensing from the moisture-laden gas to be cleansed in the electrostatic precipitator.

The object of the present invention is to provide a simple and useful arrangement by means of which cooling of the gases in the integrated cooling device in the wet electrostatic precipitator is effected uniformly. A further object is to provide an arrangement which will enable the use of high-alloy steel, particularly in structural elements subjected to a corrosive atmosphere, by reduction of the rate of corrosion, and/or an arrangement which will enable the use of a cheaper, steel of lower quality, i.e. steel having lower alloy contents. This object is achieved by the arrangement having the characteristic features set forth in the following claims.

The inventive arrangement thus affords an important advantage of economic character, since the arrangement prolongs the technical life of the wet electrostatic precipitator when, for instance, the collector electrodes surrounding the emission electrodes and consisting, e.g., of tubular constructions are made from a certain, given alloyed steel. The inventive arrangement also provides another economic advantage, in that it is possible to select a low-alloyed steel for the manufacture of the collector electrodes and still achieve good corrosion resistance and a prolonged technical, useful life of the collector electrodes. The inventive arrangement also enables the effective cleansing of highly problematic flue gases which could not otherwise have been processed in a steel construction without needing to use, for instance, lead or plastic constructions with associated drawbacks.

The invention will now be described in more detail with reference to exemplifying embodiments thereof illustrated in the accompanying drawings, in which FIG. 1 is a partially transparent, perspective view of an electrostatic precipitator intended for cleansing moist gases, i.e. a so-called wet electrostatic precipitator having a condensing cooling arrangement integrated therewith;

Figure 1:
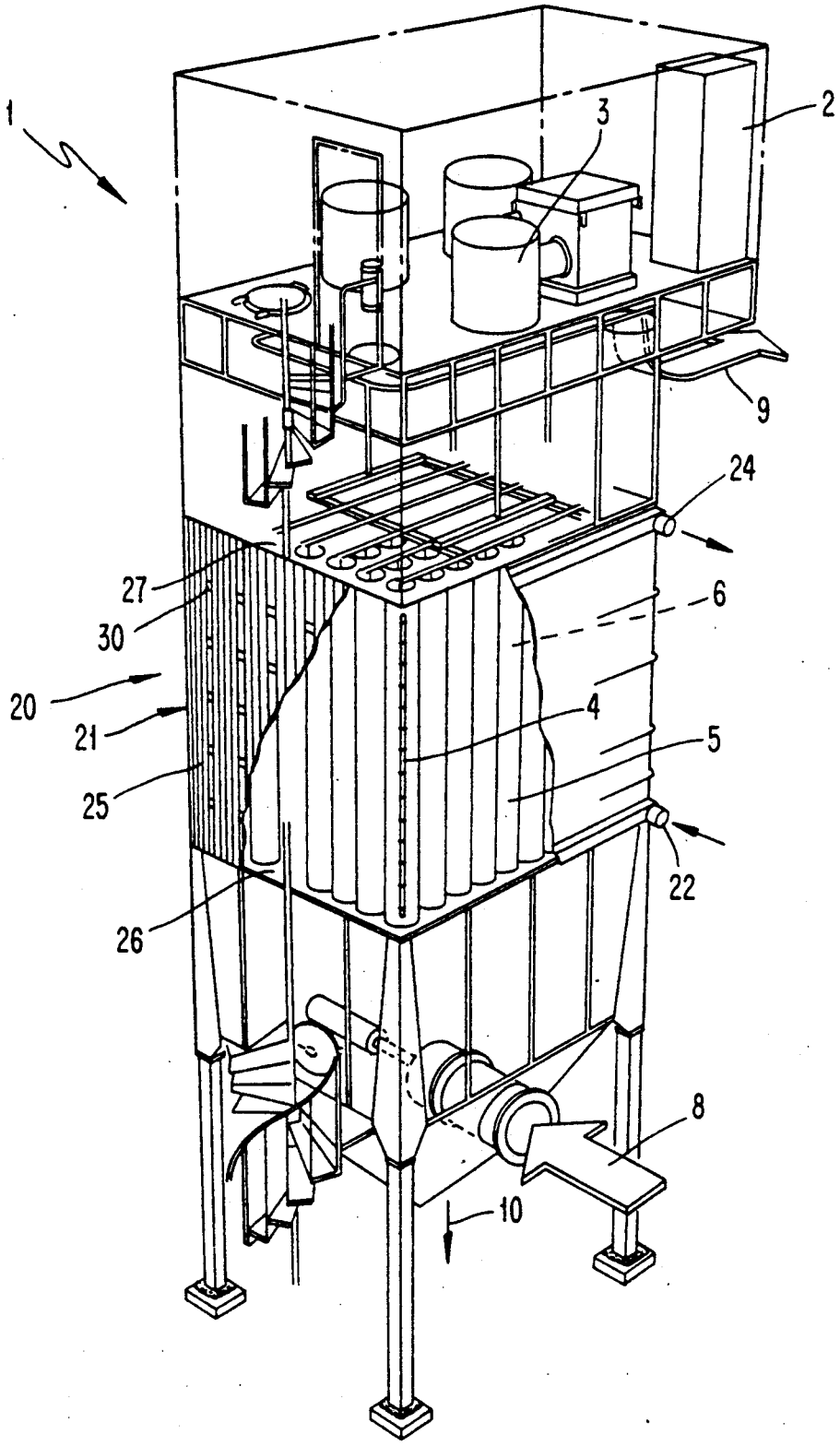

FIG. 1 illustrates an electrostatic precipitator in the form of a wet electrostatic precipitator equipped with an integrated condensing cooling arrangement. The illustrated wet electrostatic precipitator 1 includes a high-voltage source 2 and isolators 3 which carry a plurality of emission electrodes 4, via a framework construction. Each emission electrodes 4 is surrounded by a collector electrode 5, suitably of tubular construction. The voltage source 2 is operative to create a potential difference between the emission electrodes 4 and the surrounding collector electrodes 5, such as to generate an electric field in a region 6 between said electrodes. The moisture and dust laden gas flows through the region 6 and the dust and moisture particles are so influenced by the electric field that they deposit primarily on the inner surfaces of the collector electrodes 5, i.e. the inner surfaces of the tubes, so that the gas is essentially cleansed from moisture and dust particles when exiting from the dust precipitator. The flow of moisture and dust laden gas into the wet electrostatic precipitator 1 is symbolized by the arrow 8, whereas the cleansed gas exiting from the precipitator 1 is symbolized by the arrow 9.

As previously mentioned, the moisture and dust laden gas flows up through the tubular collector electrodes 5, and the potential difference, preferably in the form of a d.c. voltage, created between the collector electrodes 5 and the emission electrodes 4 results in a glow and a corona discharge, therewith exerting the maximum separation on the individual moisture and dust particles carried by the gas and therewith the maximum possible gas cleansing effect, the particles of moisture and dust being collected essentially on the inner surfaces of the tubes 5 and falling downwards from the precipitator 1 in the direction of the arrow 10.

Figure 2:
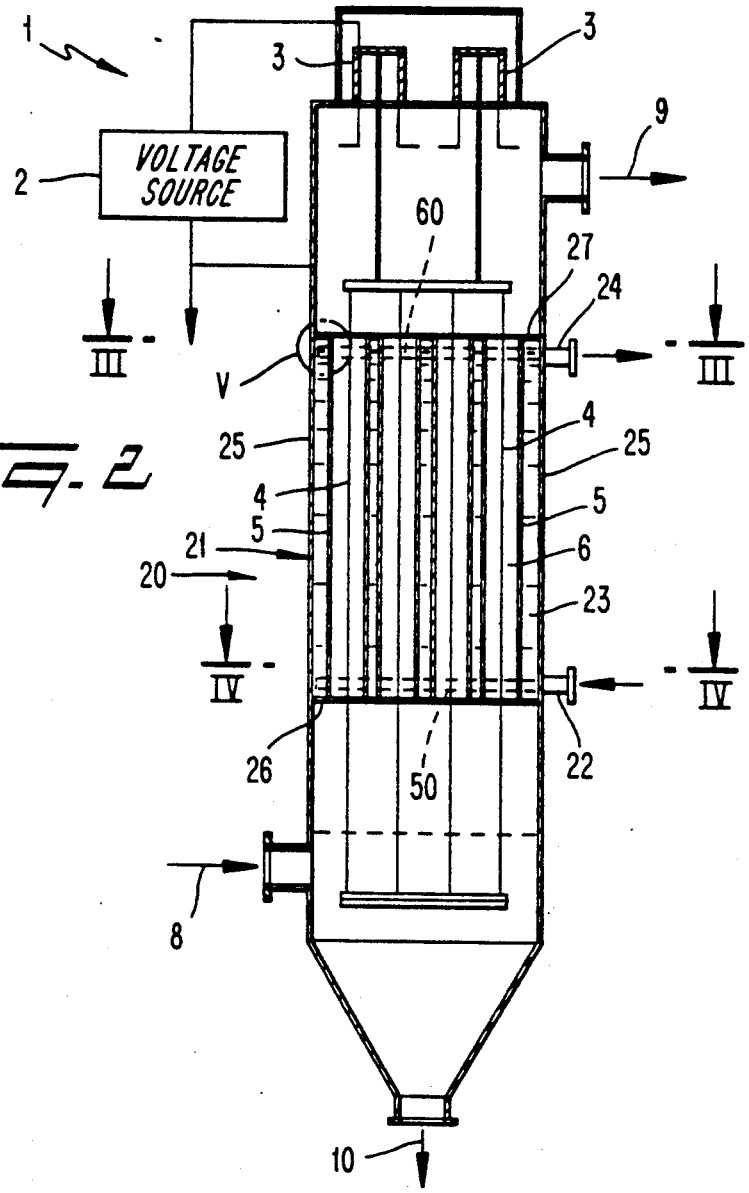
FIG. 2 is a schematic, longitudinal sectional view of a wet electrostatic precipitator provided with the inventive arrangement.

When applicable, the components of the FIG. 2 illustration have been identified with the same references as those used in FIG. 1.

Figure 3:
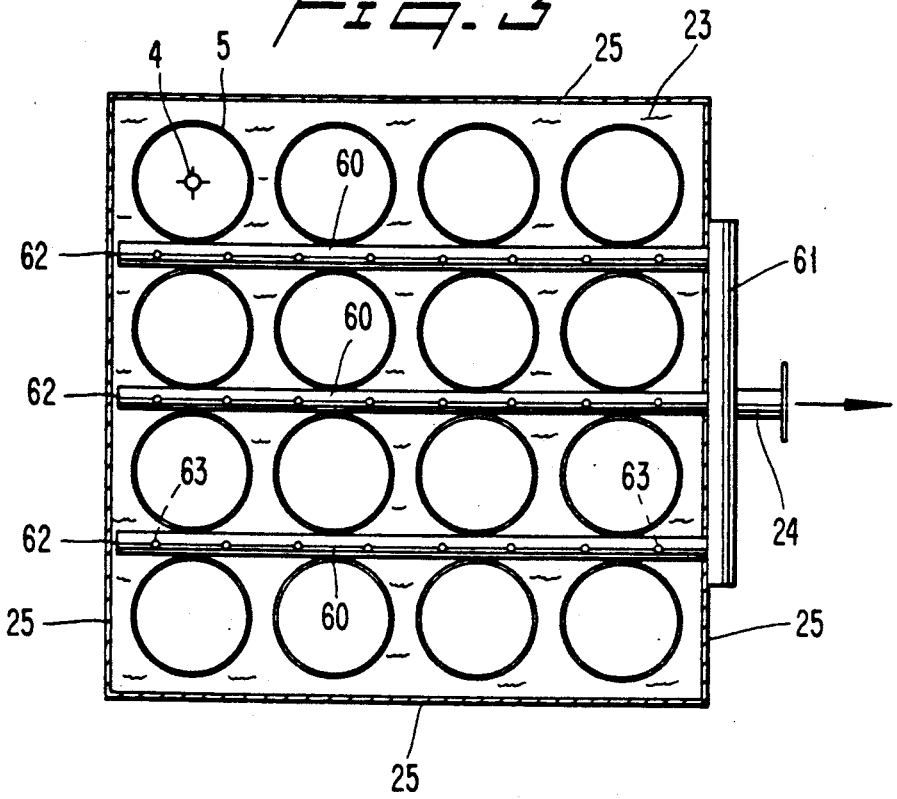
FIG. 3 is a sectional view of the arrangement shown in FIG. 2 taken on the line III—III in said figure.
Figure 4:
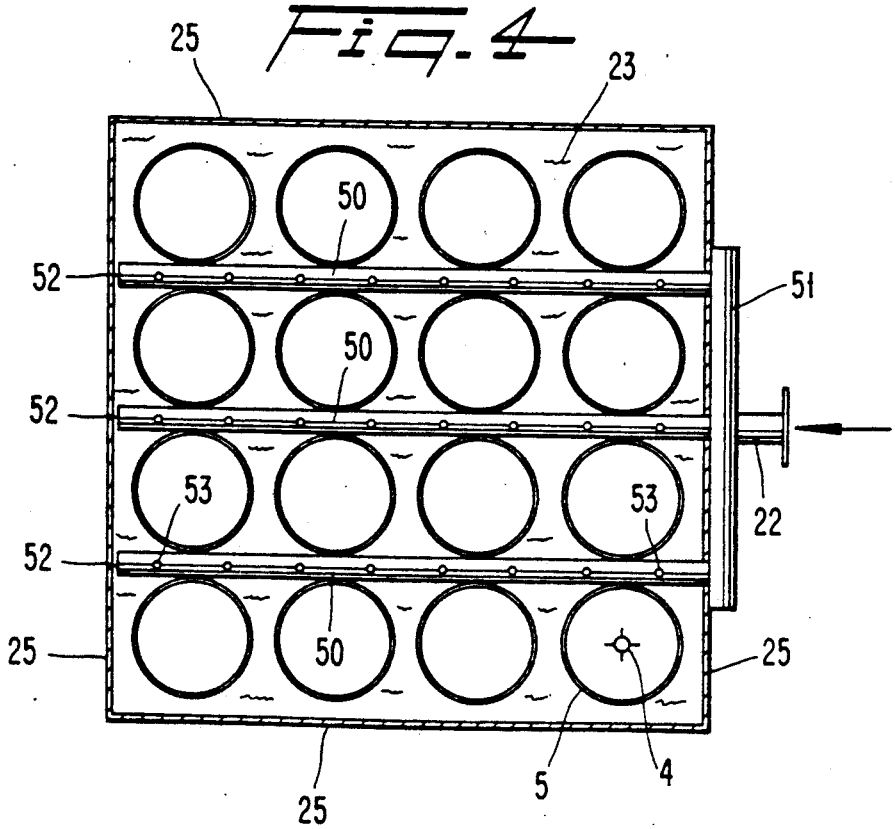
FIG. 4 is a sectional view of the arrangement shown in FIG. 2, taken on the line IV—IV in said figure.

In accordance with the present invention, the precipitator unit or separation unit 20 of the wet electrostatic precipitator 1 includes a condensing cooler arrangement 21 which has an inlet 22 for cooling medium 23, said cooling medium preferably being a liquid coolant, for instance water. The cooling arrangement 21 also includes a cooling-medium outlet 24. The cooling arrangement 21 is defined externally by metal shell-plates 25, a bottom plate 26 and a top plate 27. The bottom plate 26 and the top plate 27 are provided with holes for accommodating the tubular collector electrodes 5 and a connection which will ensure against leakage of cooling medium, e.g. a welded connection, is provided between the tubes 5 and the plates 26 and 27. Thus, as indicated in FIGS. 2–4, the circulating cooling medium 23 fills the space defined between the outer surfaces of the tubes 5 and the outer casing of the cooler, said outer casing being formed by the shell plates 25, the bottom plate 26 and the top plate 27.

Draw rods 30 are preferably disposed between the sheel plates 25, for reasons of mechanical strength.

The inventive precipitator unit 20 thus includes the collector electrodes 5, the emission electrodes 4, located centrally in and coaxially with said collector electrodes, and the condensing cooling arrangement 21.

Because, inter alia, acid and ion-containing aerosols present in the flue gases are deposited within the tubular collector electrodes 5, it is often necessary to construct the tubular collector electrodes from an expensive, high-alloy steel or from a still more corrosion-resistant material, resulting in relatively high costs with respect to the wet electrostatic precipitator 1. The aforesaid external cooling of the tubes 5 will thus lower the temperature of the tubes and enhance condensation on the inner surfaces of the tubes. This enables the rate at which the tubes 5 are corroded as a result of the corrosion-promoting layers of condensation forming on the inner surfaces of the tubes to be reduced. A special arrangement is provided in accordance with the invention for the purpose of achieving uniform cooling of all tubular collector electrodes 5. The inventive arrangement enables all tubes 5, which enclose electrodes in the precipitator 20, to be cooled uniformly. This is achieved by providing means in the form, e.g., of a plurality of distributing pipes 50 and 60 in both the upper and the lower end parts of the precipitator unit 20.

It will be understood that the number of distributing pipes 50 and 60 is dependent on the number of collector electrodes 5, and in the case of the exemplifying embodiments, illustrated in FIGS. 2–5, three such distributing pipes are provided in both the upper and the lower end parts of the precipitator unit.

As will be seen from FIG. 4, the inlet distribution pipes 50 are disposed in the lower, end-part of the precipitator unit 20 and are preferably connected in parallel so that the cooling medium entering the inlet 22 is distributed in parallel to all inlet distribution pipes 50, via a distribution channel 51. The inlet distribution pipes 50 are closed or sealed at their free ends 52 and are provided along their upper surfaces with a plurality of cooling-medium outlet holes 53.

The outlet distribution pipes 60 are shown in FIG. 3. The free ends 62 of the pipes 60 are closed or sealed and a plurality of inlet holes 63 are distributed along the bottom surface of respective pipes. The outlet distribution pipes 60 communicate with a channel 61, which in turn communicates with the cooling-medium outlet 24.

It will be understood that the inlet 22 and the outlet 24 communicate with an external cooling circuit in a manner to recover the thermal energy taken-up from the collector electrodes 5, this recovered energy being used for some useful purpose.

Figure 5:
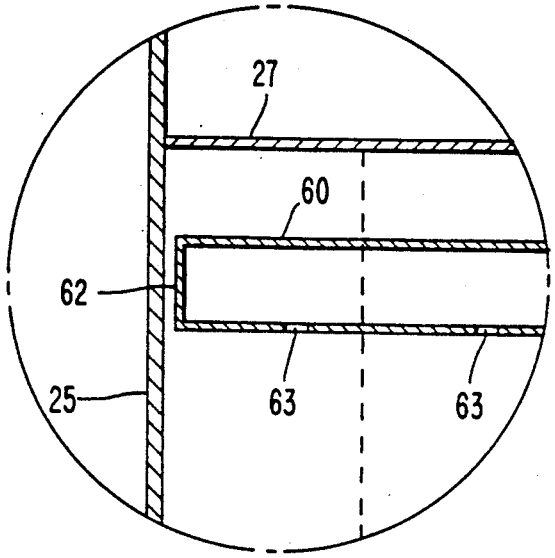
FIG. 5 is an enlarged view of the section V referenced in FIG. 2.

It will be seen from the enlarged view of FIG. 5 that the distributing tubes 60 are closed or sealed at their one end 62. This applies, of course, to both the inlet distributing pipes 50 and the outlet distributing pipes 60.

As will be understood, the distribution pipes 50 and 60 may vary in number and the dimensions of the holes 53 and 63 can vary along the length of respective pipes in a manner to compensate for the pressure drop occurring in the pipes and so that liquid will enter and exit uniformly along the whole length of the pipes. For stability reasons, the closed or sealed ends 52 and 62 of respective pipes 50 and 60 can be fixated relative to their surroundings.

A particular advantage is afforded when the liquid inlet 22 is located in the lower part of the precipitator unit and the liquid outlet 24 is located in the upper part of said unit, since co-action is then achieved with the thermal medium movement. It will be understood, however, that it lies within the scope of the invention to switch the locations of the inlet 22 and the outlet 24.

It will also be understood that the holes or openings 53 and 63, disposed in the distribution pipes 50 and 60, may be directed in mutually different directions, such as to achieve optimum distribution of coolant in the cooling arrangement 21.

The improved uniformity in distribution of the cooling medium achieved in accordance with the present invention will also result, as a secondary effect, in an improved energy yield.

The inventive arrangement thus provides a particularly effective and uniform cooling of all collector electrodes 5 which, in accordance with the aforegoing, results substantially in a lower corrosion rate in respect of the collector electrodes, as a result of the condensation formed on the inner surfaces of said electrodes. In conjunction herewith, the useful life of the wet electrostatic precipitator can be increased and/or the collector electrodes can be made of a less expensive steel having a lower alloy content than was previously possible.

For example, the exterior shell-plates 25 of the cooling arrangement 21 may be made of non-alloyed steel plate.

The following non-limitive examples can be mentioned to further illustrate the advantages afforded by the present invention:

The aerosol droplets formed, for instance, in an upstream washing tower and entering the downstream wet electrostatic precipitator often have very high concentrations of, e.g., $H_2SO_4$.

On the other hand, the amount of liquid/$H_2SO_4$ in the aerosol is small. Let us assume that it can amount to 1 g/$Nm^3$.

Assume that a wet electrostatic precipitator processes about 20,000 $Nm^3$ of gas per hour. This implies $20{,}000 \times 0.001 = 20$ kg liquid containing, let us say, 35% $H_2SO_4$ which is deposited on the inner surfaces of the tubular collector electrodes per hour.

When the gas cools, water vapour condenses onto the cooling surfaces/walls of the filter units. The amount of water vapour thus precipitated will normally lie between 500–1,500 l/h.

Assume that the gas has a saturation temperature of 60° C. and that 1,000 liters of gas are cooled each hour.

The sulphuric acid ($20\ kg \times 0.35 = 7.0\ kg$) will then be diluted with a further 1,000 liters of water.

The actual sulphuric-acid concentration will thus fall from $$35\% \text{ to } \xrightarrow[1{,}013\text{ kg}]{7\text{ kg}} \text{about } 0.7\%$$

This cooling/condensing process will mean that the new operating point for the steel in the collector electrodes will be moved, partly due to the low temperature of the steel and partly because of the radically changed acid concentration, therewith decreasing the corrosion rate of the steel.

It will be understood from the above description that the means provided in accordance with the invention for effecting uniform and efficient cooling of the collector electrodes afford very important advantages, and that the structural configuration of said means can be readily adapted to the construction of the precipitator unit and that said means are thus not dependent on the number of collector electrodes present or their form and configuration.

In those instances when, for instances, it is preferred to configure the precipitator unit 10 with circular outer contours or cross-sectional shape, such that the shell plates 25 of the cooling arrangement 21 are, in principle, replaced by a relatively large tube, it is preferred that at least certain of the distribution pipes 50, 60 are given a curvature adapted to the circular contour aforementioned.

The invention is thus not restricted to the illustrated and described embodiments, since changes and modifications can be made within the scope of the following claims.

I claim:

1. An arrangement in a wet electrostatic precipitator (1) for cleansing moisture and dust laden gases, said wet electrostatic precipitator (1) including a condensing cooler arrangement (21) integrated with the precipitator unit (20) of said electrostatic precipitator, and in which emission electrodes (4) are disposed within a plurality of collector electrodes (5) which extend through the cooling arrangement (21), and in which the gas flows forwardly through the collector electrodes (5), wherein distribution pipes (50, 60) are disposed in a region between the collector electrodes (5) such as to provide uniform distribution of cooling medium along the outer surfaces of the collector electrodes.

2. An arrangement according to claim 1, the distribution pipes (50, 60) are closed or sealed at their respective one ends (52 and 62 respectively).

3. An arrangement according to claim 1, the distribution pipes (50, 50) are provided with a plurality of openings (53 and 63 respectively) along their lengths.

4. An arrangement according to claim 3, the distribution pipes (50, 60) are closed or sealed at their respective one ends (52 and 62 respectively).

* * * * *

UNITED STATES PATENT AND TRADEMARK OFFICE

CERTIFICATE OF CORRECTION

PATENT NO. : 5,039,318

DATED : August 13, 1991

INVENTOR(S) : Harry JOHANSSON

It is certified that error appears in the above-identified patent and that said Letters Patent is hereby corrected as shown below:

In column 6, line 34, before "the distribution" insert --wherein--;

line 37, before "the distribution" insert --wherein--; and line 40, before "the distribution" insert --wherein--.

Signed and Sealed this

Sixth Day of April, 1993

*Attest:*

STEPHEN G. KUNIN

*Attesting Officer*

*Acting Commissioner of Patents and Trademarks*